US006354769B1

(12) United States Patent
Allen

(10) Patent No.: US 6,354,769 B1
(45) Date of Patent: Mar. 12, 2002

(54) APPARATUS AND METHOD FOR REPLACING IN-GROUND ELEVATOR CYLINDER CASINGS

(76) Inventor: Patrick Richard Allen, 8521 Gardena Rd., Lakeside, CA (US) 92040

( * ) Notice: Subject to any disclaimer, the term of this patent is extended or adjusted under 35 U.S.C. 154(b) by 0 days.

(21) Appl. No.: 09/317,758

(22) Filed: May 24, 1999

(51) Int. Cl.[7] ..... E02D 7/28; B66F 7/00

(52) U.S. Cl. ..... 405/303; 405/232; 405/245; 187/205; 187/272; 254/386

(58) Field of Search ..... 405/231, 232, 405/244, 245, 247, 248, 285, 303, 52, 187, 254; 52/30, 169.1; 187/215, 272, 275; 254/386

(56) References Cited

U.S. PATENT DOCUMENTS 3,741,075 A * 6/1973 Moseley et al. ..... 91/451
3,902,573 A * 9/1975 Grove et al. ..... 187/290
3,960,360 A * 6/1976 Elliston ..... 254/386 X
3,968,860 A * 7/1976 Atkey ..... 187/272
4,251,176 A * 2/1981 Sizer et al. ..... 254/336 X
4,361,209 A * 11/1982 Kappenhaagen et al. ... 187/272
4,735,291 A * 4/1988 Kappenhagen ..... 187/272
4,807,724 A * 2/1989 Martin ..... 187/110
4,983,072 A * 1/1991 Bell, Jr. ..... 405/216
5,110,090 A * 5/1992 McDuffle ..... 254/124
5,302,052 A * 4/1994 Agustsson et al. ..... 405/133
5,307,386 A * 4/1994 Chavez et al. ..... 376/260
5,501,299 A * 3/1996 Holmes ..... 187/272
5,709,286 A * 1/1998 Mead et al. ..... 187/205
5,860,491 A * 1/1999 Fletcher ..... 187/272 X

FOREIGN PATENT DOCUMENTS

JP 53023464 A * 3/1978 ..... 187/272

* cited by examiner

*Primary Examiner*—David Bagnell
*Assistant Examiner*—Jong-Suk Lee
(74) *Attorney, Agent, or Firm*—Brown, Martin, Haller & McClain LLP

(57) ABSTRACT

A method and apparatus for replacing old, in-ground hydraulic elevator lift cylinders in which a portable tower is erected within the elevator hoistway and a shoring sleeve of larger diameter than the old cylinder is secured to a head plate slidably mounted for vertical movement on the tower and facing downwardly. After loosening the hoistway floor and subsoil surrounding the old cylinder, a drive mechanism such as a winch or hydraulic jack is actuated to lower the shoring sleeve into the ground to surround the old cylinder. The head plate is then attached to the old cylinder, and the drive mechanism is actuated to lift the head plate and cylinder upwardly until the cylinder is raised completely out of the ground. The old cylinder is discarded, and a new cylinder is attached to the head plate and lowered into the area surrounded by the shoring sleeve.

20 Claims, 5 Drawing Sheets

APPARATUS AND METHOD FOR REPLACING IN-GROUND ELEVATOR CYLINDER CASINGS

BACKGROUND OF THE INVENTION

The present invention relates to a method and apparatus for replacing in-ground hydraulic elevator cylinder casings.

A hydraulic elevator shaft cylinder is typically made of steel and is installed in a bored hole in the ground. The cylinder is therefore exposed to soil and ground water. As a result, corrosion will occur and the cylinder must eventually be replaced. Since the cylinder is installed below ground, within an elevator hoistway, and typically beneath a building, replacement of the corroded cylinder involves substantial difficulty and expense.

Various proposals have been made in the past for either reducing the corrosion problem or for reducing the problems inherent in replacing corroded cylinders. U.S. Pat. Nos. 4,983,072 of Bell, Jr, U.S. Pat. No. 5,076,146 of Bialy, U.S. Pat. Nos. 5,226,751, and 5,501,299 of Holmes all related to methods for protecting the outer surface of a submerged cylinder from corrosion, and do not suggest any method or apparatus for replacing the cylinder if and when it fails. Other methods and devices have been proposed in the past for retrofitting hydraulic lift cylinders, such as U.S. Pat. No. 5,860,491 of Fletcher. This patent describes a system and method for retrofitting a low pressure high volume lift system which involves installing a new cylinder inside the old cylinder, which is left in place. U.S. Pat. No. 5,709,286 of Mead describes another system in which a new lift assembly is installed directly within an existing in-ground cylinder. Thus, the old cylinder casing is not removed in either the Mead or Fletcher system.

Removing an existing, elongated cylinder in an enclosed field condition is a most difficult undertaking, so much so that the U.S. Government awarded a specialty contract (resulting in U.S. Pat. No. 5,307,386 of Chaves et al.) to develop a device for removing elongated coolant pumps suspended under steam generators within containment vessels in power plant switch limited access space. This patent is applicable only to the particular field described, specifically removal of large elongated pump motors suspended beneath a steam generator, and would not work in an elevator hoistway, or an unstable earthen bore hole. However, it does serve to demonstrate the need for devices to remove equipment with limited access space.

The current method used to remove an elevator hydraulic jack cylinder casing is to first suspend the elevator car from the top of the hoistway with a suitably strong beam placed on the roof of the building above the elevator shaft. In order to do this, a hole must first be cut through the building roof, and a chain with a hook or cable snatch block is then suspended from the beam into the elevator shaft. The elevator car is then hoisted up to the top of the elevator shaft with a chain fall suspended from the hook or snatch block. A winch device is then mounted within the elevator pit and a line is then affixed to a snatch block suspended from the bottom of the elevator car. This winch line is then used to lift the old, corroded elevator hydraulic jack cylinder casing out of the ground. This method often creates problems, such as spillage of hydraulic fluid, or cave-in of the shaft hole as the old cylinder casing is withdrawn from the hole. Also, the elevator car carriage is subject to racking/misalignment due to the weight of the hydraulic cylinder casing suspended from its bolster channels (under the elevator car). Under this current practice, the shaft hole must typically be pre-drilled, and thereafter, the new or replacement elevator hydraulic cylinder casing is installed using the chain winch suspended from the elevator car as a lifting device. This method is both time-consuming and expensive.

SUMMARY OF THE INVENTION

It is an object of the present invention to provide a new and improved apparatus and method for removing and replacing in-ground elevator hydraulic cylinder casings.

According to one aspect of the present invention, a method of removing and replacing an in-ground elevator hydraulic cylinder casing is provided, which comprises the steps of:

- loosening an elevator hoistway floor and subsoil surrounding an in-ground elevator hydraulic cylinder casing to leave a gap around the casing;
- centering a shoring sleeve of larger diameter than the in-ground hydraulic cylinder casing in an elevator hoistway above the floor of the hoistway centered on the in-ground cylinder casing;
- lowering the shoring sleeve into the gap around the cylinder casing and forcing it down until it surrounds the entire outer surface of the casing to a depth below the lower end of the casing;
- pulling the cylinder casing upwardly into the hoistway and disposing of the extracted cylinder casing; and
- lowering a new hydraulic cylinder casing into the shoring sleeve.

In an exemplary embodiment of the invention, the method includes the steps of erecting a temporary hoist tower within an elevator hoistway to extend upwardly from the bottom of the hoistway in alignment with the in-ground elevator hydraulic cylinder casing, and mounting a drive assembly on the temporary hoist tower above the buried hydraulic cylinder casing. The drive assembly is then used to force the shoring sleeve downwardly to surround the hydraulic cylinder casing, and is then attached to the buried cylinder casing and used to lift the cylinder casing from the ground. The drive assembly may be a power winch or a hydraulic jack, or both a power winch and a hydraulic jack applied in unison where large frictional forces are to be overcome.

According to another aspect of the present invention, an apparatus for removing an old elevator hydraulic cylinder casing from the ground and replacing it with a new hydraulic cylinder casing is provided, which comprises a vertical tower having a lower end for mounting on the floor of an elevator hoistway centered over an in-ground hydraulic cylinder casing and extending vertically upwardly from the floor, a head plate slidably mounted on the tower for vertical movement up and down the tower, a releasable locking device for releasably securing the head plate at a selected height on the tower, the head plate having a downwardly facing attachment device for securing the head plate to a shoring sleeve or cylinder, and a pressing and lifting assembly for forcing the head plate downwardly along the tower to move a shoring sleeve or cylinder attached to the head plate to submerged, in-ground position below the floor of the elevator hoistway, and for lifting the head plate upwardly to lift an old cylinder casing from an in-ground position to a removed position spaced above the floor of the elevator hoistway.

In an exemplary embodiment of the invention, a beam is slidably mounted on the tower above the head plate, and a releasable locking device is provided for releasably locking the beam at a selected position on the tower, and at least one hydraulic jack may be mounted between the head plate and beam for lowering the head plate relative to the beam. A hydraulic jack may also be mounted between the lower end of the tower and the head plate for lifting the head plate in order to exert lifting force on an attached in-ground cylinder casing. A cable winch assembly may be provided for assisting in the lifting procedure, including a winch secured near the base of the tower and a cable and pulley assembly secured to the winch. Pulleys may be secured on the opposite side of the tower to the winch and to the top of the head plate.

The method and apparatus of this invention avoids the need to use an existing elevator car as a lifting anchor in replacing of old hydraulic cylinder casings, and thus avoids the risk of racking or misalignment of the car. The method involves installation of a shoring sleeve around the old cylinder casing prior to removal, thus avoiding or reducing the risk of the bore caving in before a new cylinder casing is installed. This method and apparatus also minimizes leakage of hydraulic fluid to the surrounding sub-soil as the old casing is removed.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
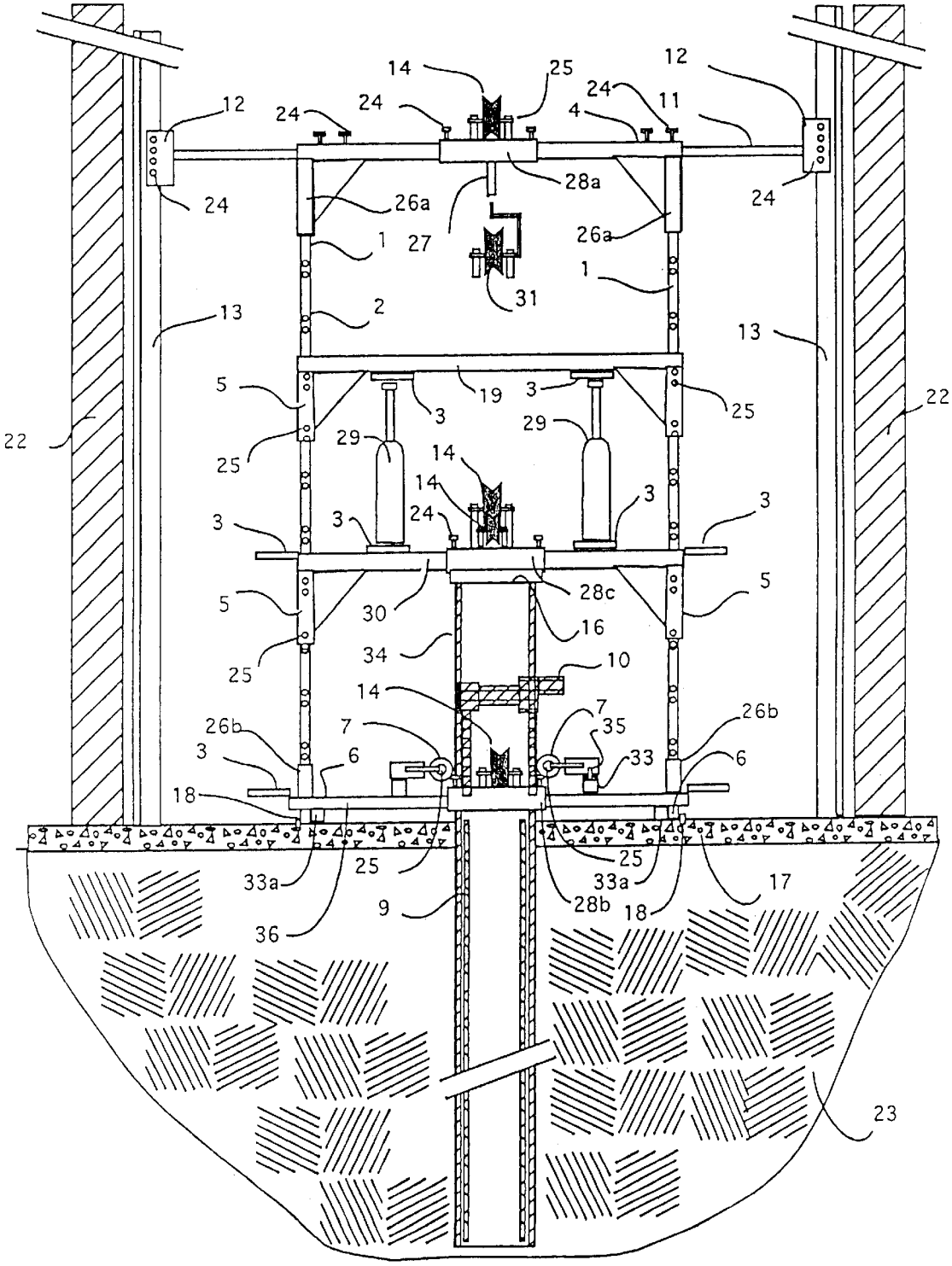
FIG. 1 is a side elevational view of an apparatus according to an exemplary embodiment of the present invention installed in an elevator hoistway prior to removal of an old, in-ground hydraulic cylinder casing.
Figure 2:
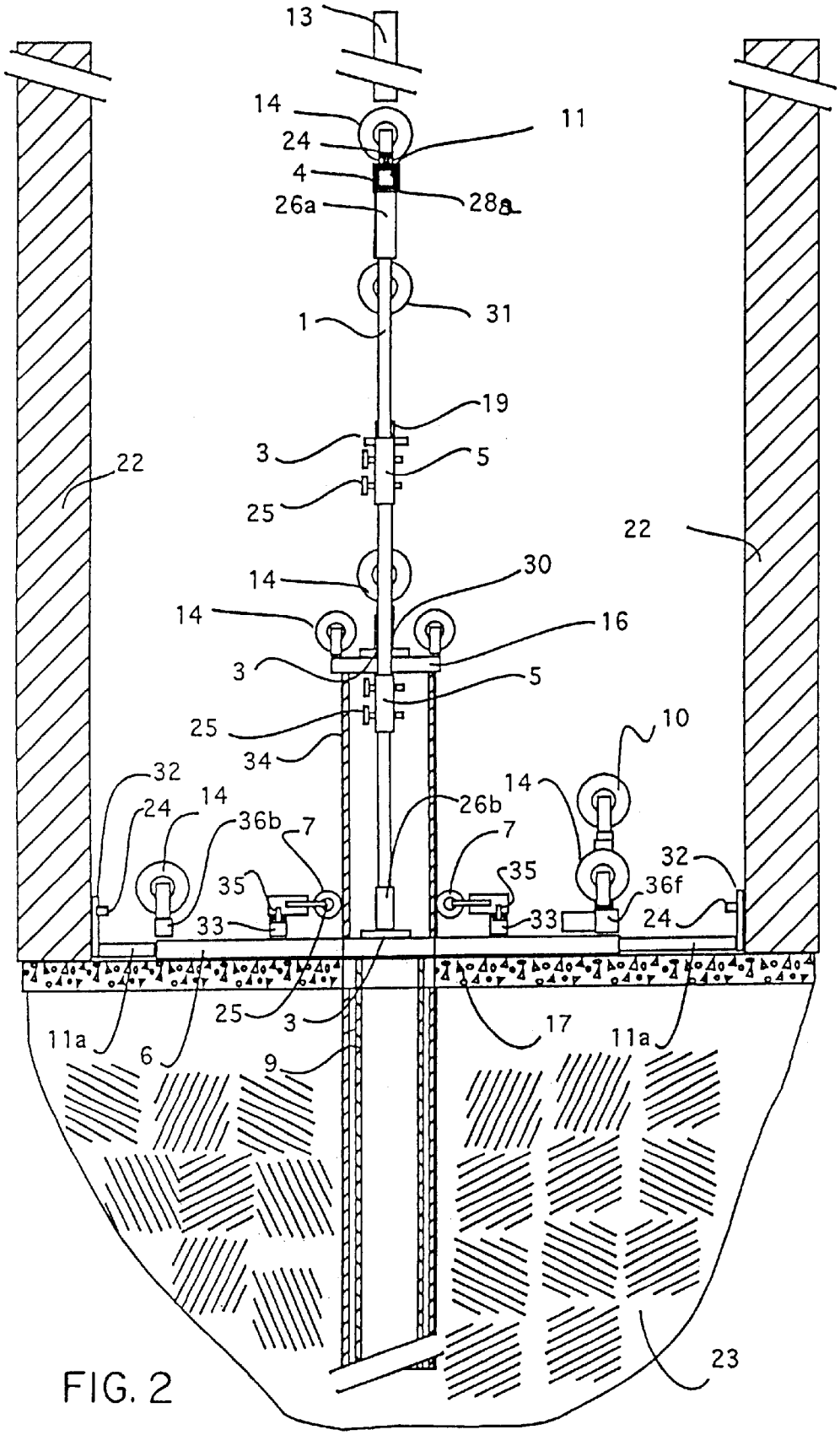
FIG. 2 is a vertical cross-section on the lines 2—2 of FIG. 1.
Figure 3:
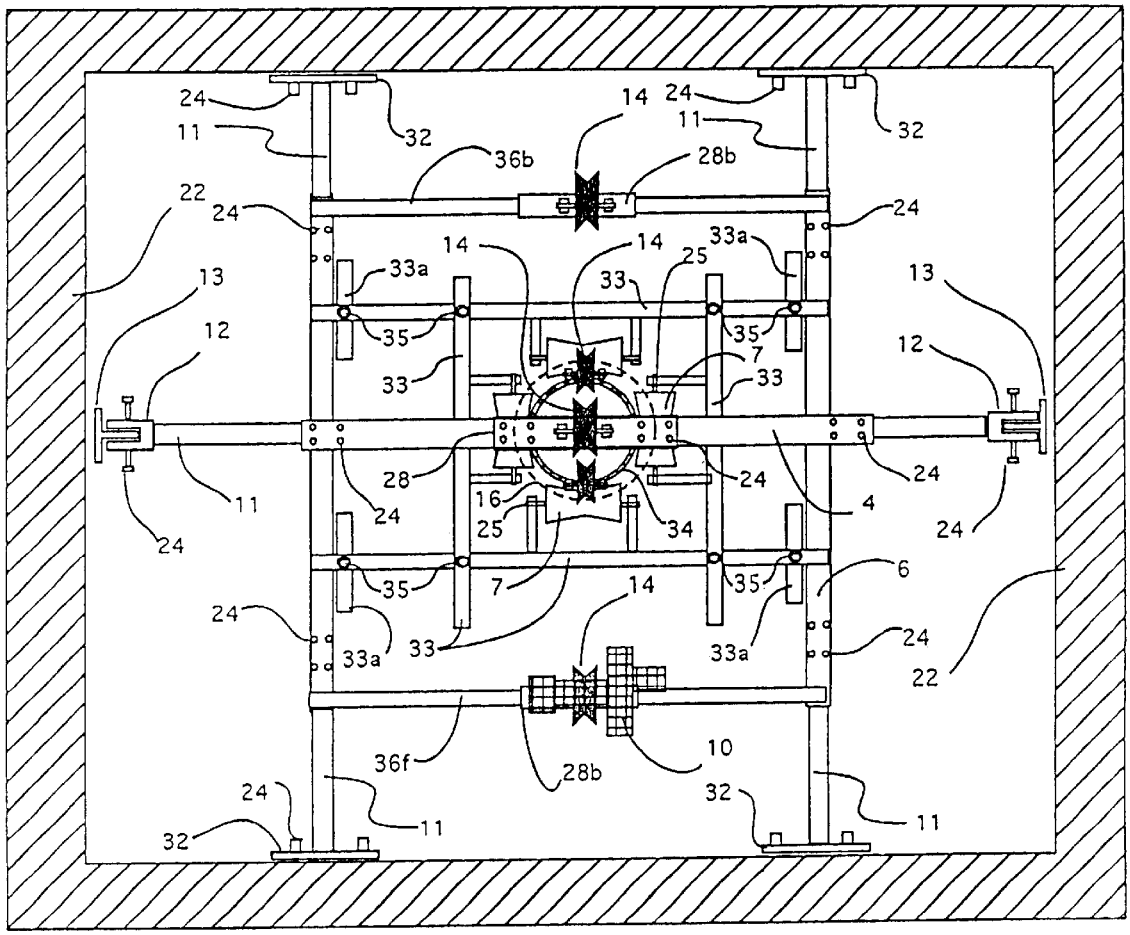
FIG. 3 is a top plan view of the apparatus of FIG. 1.

FIGS. 1 to 3 of the drawings illustrate an elevator lift cylinder replacement apparatus according to an exemplary embodiment of the present invention. The apparatus basically comprises a vertical portable tower for installation in an elevator hoistway 22, with the base 6 of the tower supported on the concrete floor 17 of the hoistway and the tower centered over an in-ground, old hydraulic cylinder casing 9 which is embedded in a bore in the earth or sub-soil 23 beneath floor 17. The tower is equipped with lifting and lowering mechanisms for removal of the existing casing and replacement with a new casing as well as an outer shoring sleeve 34, as will be described in more detail below.

The tower basically comprises a pair of spaced, vertical tower supports 1 each having a plurality of quick connect holes 2 spaced along their length, and a mule head or cross bar 4 extending between the upper ends of the supports 1 and secured to the supports via mounting sockets 26*a* secured at opposite ends of mule head 4. The mule head or cross bar 4 is hollow, and a telescoping end rod or expansion member 11 is slidably mounted in each end of the mule head 4 and releasably secured in position in the mule head 4 via set screws 24. A transverse end flange 12 is mounted at the outer end of each rod 11 for engagement with a respective elevator T-rail 13, as best illustrated in FIG. 3. The flanges 12 are clamped or affixed to the respective T-rails with set screws 24, thus securing the upper end of the tower in the hoistway. A first cable sheave or pulley 14 is mounted on the upper side of a sleeve 28*a* slidably mounted on mule head or cross bar 4, which is also secured at a selected position on the cross bar via set screws 24. A hook eye 27 is welded to the lower side of sleeve 28*a*, and a typical swivel hook cable block 31 may be suspended from hook eye 27, as indicated in FIG. 1.

The base mounting of the tower will now be described in more detail. Each vertical tower support 1 has a socket 26*b* at its lower end which is welded to a respective mounting base 6. Mounting bases 6 comprise hollow bar members extending transversely across the lower end of the supports 1 in a direction transverse to mule head 4, as best illustrated in FIGS. 1 and 3. The mounting bases 6 may be secured to the floor slab 17 with concrete anchors 18, as indicated in FIG. 1. Alternatively, as indicated in FIGS. 2 and 3, they may be secured in the hoistway in a similar manner to the mule head 4, via end rods 11*a* telescopically mounted in the opposite ends of each bar 6 and releasably secured at a selected extension via set screws 24. Each end rod 11*a* has an end plate 32 mounted across its outer end. The end rods 11*a* are extended until they contact the walls 22 of the hoistway. Set screws 24 which extend through plates 32 are then tightened to apply pressure against the walls, holding the base bars 6 in position, as indicated in FIGS. 2 and 3.

Back and front foot bars 36*b* and 36*f* extend between the two base bars 6 at opposite ends of the bars, and are bolted to the respective bars to form a generally square base structure, as indicated in FIG. 3. Horizontal sleeves 28*b* are slidably mounted on the respective foot bars 36*b* and 36*f*. A cable guide pulley 14 is rotatably mounted on top of each sleeve 28*b*, as indicated in FIGS. 2 and 3, and a power winch is welded on top of the sleeve 28*b* on front foot bar 36*f*, adjacent pulley 14. A first pair of unistrut framing channels 33 are also secured between the base bars 6 at locations spaced inwardly from foot bars 36*b* and 36*f*, as indicated in FIG. 3. A second pair of unistrut framing channels 33 are secured transversely between the first set of channels 33, to form a generally square shape, via slide nuts 35 which allow the second pair of channels 33 to be moved inwardly and outwardly along channels 33. The first pair of channels 33 are also slidably mounted via slide nuts 35 on channels 33*a*, which are welded to extend parallel to the respective base bars 6, as indicated in FIG. 3. An inwardly projecting, quick disconnect roller guide 7 is centrally mounted on each of the framing channels 33. Thus, the positions of the four roller guides 7 can be adjusted by sliding the respective first pair of framing channels 33 along end channels 33*a*, and sliding the second pair of framing channels 33 relative to the first pair. The roller guides 7 are secured to the respective framing channels 33 by means of quick-connect pins 25.

Upper and lower cross beams 19 and 30 are slidably mounted across the tower by means of sleeves 5 welded at opposite ends of the respective beams 19,30 and slidably mounted on the respective vertical support 1, as indicated in FIG. 1. Quick connect pins 25 are passed through the sleeves 5 and into selected bolt holes 2 in order to releasably secure each beam 19,30 at a selected height in the tower. A sleeve 28*c* is slidably mounted on the lower beam 30 and may be secured at a selected position via set screws 24. A fourth cable guide sheath or pulley 14 is rotatably mounted on top of sleeve 28*c*, as illustrated in FIG. 1. A circular head plate 16 is welded to the lower surface of sleeve 28*c*, and includes a suitable downwardly facing fastener mechanism for securing the head plate to a hydraulic cylinder casing or to a shoring sleeve 34, as will be described in more detail below. A suitable cable line 15 extends from winch 10 around the various pulleys 14 in order to assist in raising or lowering the head plate 16, as will be described in more detail below.

Figure 6:
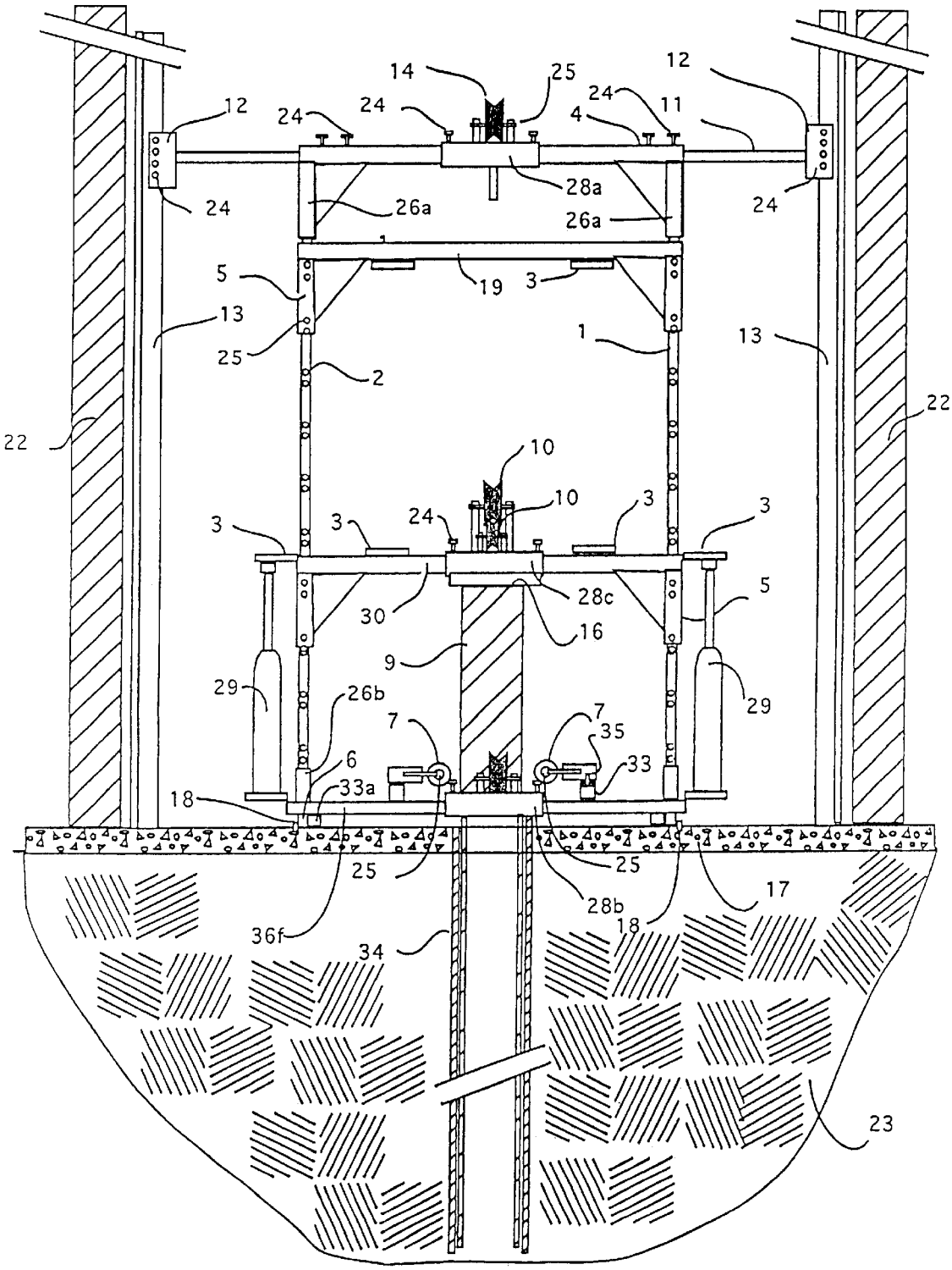
FIG. 6 is a side elevational view similar to FIG. 1, illustrating the apparatus in the same position as FIG. 5.

A first pair of jacking platforms 3 are welded to the lower surface of the upper cross beam 19, while a second pair of jacking platforms 3 are welded to the upper surface of the lower cross bar or beam 30 in alignment with platforms 3 on the beam 19. A pair of jacking platforms 3 is also welded at opposite ends of the beam 30, and corresponding jacking platforms 3 are welded on base 6 in alignment with the outer end platforms 3 on beam 30. A pair of hydraulic jacks may be positioned between the jacking platforms on beams 19 and 30, as indicated in FIG. 1, in order to push the beam 30 downwardly, or between the jacking platforms on base 6 and beam 30, as indicated in FIG. 6, in order to push beam 30 upwardly.

The method of removing an old, corroded hydraulic jack cylinder casing and replacing it with a new casing using the apparatus described above will now be described in more detail. The existing corroded elevator hydraulic jack cylinder casing 9 to be replaced is typically cast in place in the concrete floor slab 17 of the elevator hoistway. The first operation is to jack hammer around the casing 9 to loosen it from the concrete floor slab 17. The earth or subsoil 23 around the outside of casing 9 is then jetted with water and pressurized air down to a depth of 90% of its entire length, to leave an annular gap around the periphery of casing 9. The water jetting process will flush waste hydraulic fluid and other waste oils from the subsoil around casing 9. The waste fluids are collected and disposed of in an environmentally safe manner according to industry standard practice.

The tower apparatus of this invention is then assembled in the hoistway. First, the mounting base 6 is secured to the floor slab with concrete anchors 18, as in FIG. 1, or via the telescoping expansion end sleeves 11*a* with end plates 32 pressing firmly against the concrete hoistway walls 22, as in FIGS. 2 and 3. The tower is centered as closely as possible on the center of the in-ground casing 9. Front and back foot bars 36*f* and 36*b* are then bolted in place on the base 6. The upper end of the tower is secured in position via expansion end sleeves 11 and flanges 12 which are secured to the T-rails 13 with compression exerted with set screws 24 extending through flanges 12. Care is taken so that there is no damage to the elevator T-rails and the mule head or cross bar 4 is perfectly centered over the old casing 9, as indicated in FIG. 3.

The sliding sleeves 28*a* and 28*c* on the mule head or top cross bar 4 and on the head plate bar 30 are then adjusted until they are aligned centrally relative to the central axis of the old casing 9, and are secured in the adjusted position by set screws 24. Sliding sleeves 28*b* on the front and rear base foot bars 36*f* and 36*b* are also adjusted to align with the other centered sleeves 28*a* and 28*c*, as best illustrated in FIG. 3, and these sleeves are also secured in the centered position by set screws 24. The first pair of framing channels 33 are then bolted at right angles to the channels 33a secured to the respective base bars 6, and the second pair of framing channels 33 are bolted perpendicular to the first pair to form a square frame centered on the old casing, as also illustrated in FIG. 3. The roller guides 7 may be aligned and fixed to each framing channel 33 either prior to or subsequent to installation of channels 33 on the base of the tower.

Figure 4:
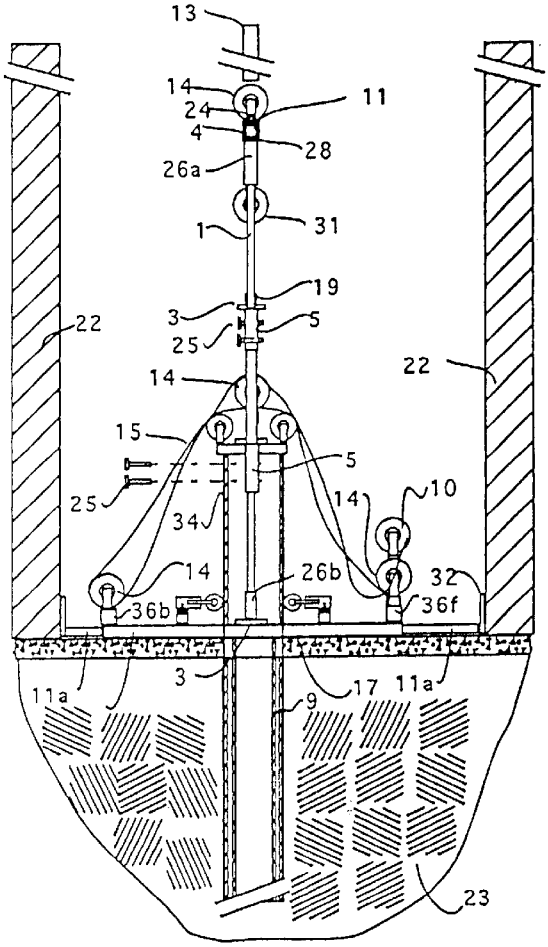
FIG. 4 is a side elevational view in the same direction as FIG. 2, illustrating use of a power winch to lower a head plate and attached shoring sleeve in the hoistway until the shoring sleeve surrounds the in-ground cylinder casing.

A shoring sleeve 34 of suitable corrosion resistant material such as plastics or PVC is then mounted on the head plate 16 above the concrete floor 17. Sleeve 34 is of larger diameter than the old casing 9. The quick connect pins 25 securing the head plate bar 30 to the uprights 1 via sleeves 5 are then removed, leaving the bar 30 free to slide downwardly. The shoring sleeve 14 is then forced downwardly into the gap around the old casing 9 to a depth of 90% of the casing depth, using the power winch 10 to exert downward force on bar 30 in the manner illustrated in FIG. 4. FIG. 4 shows the path of cable line 15 passing over and around the cable sheaves or pulleys 14 on the foot bars 36*b* and 36*f* and on the sleeve 28*c* in order to provide downward force on the bar 30 and attached shoring sleeve 34. Alternatively, the necessary downward force may be applied to the shoring sleeve by means of hydraulic jacks 29 positioned between the upper cross bar 19 and lower cross bar or head plate bar 30, as indicated in FIG. 1. If necessary, both hydraulic jacks 29 and power winch 10 may be used together to apply downward force on the head plate 16 and shoring sleeve 34. As the shoring sleeve 34 is pushed down, the quick connect pins 25 securing the roller guides 7 to the respective framing channels 33 may be removed to allow re-positioning of the roller guides each time a pipe joint must pass through the roller guides 7, so that critical alignment of the shoring sleeve is not lost. The shoring sleeve 34 is of large enough diameter to slide over the existing protective casing, as indicated in the drawings.

After the shoring sleeve 34 is forced down to a depth of around 90% of the length of the old casing 9, additional water and air pressure is jetted down to the lowest 10% of the depth of casing 9, so as to loosen the subsoil surrounding the casing in this region. The sleeve 34 is then forced down to below the lowest level of casing 9 using either the power winch or the hydraulic jacks 29, or both.

The old casing 9 can then be removed, attaching the upper end of the casing 9 to the head plate 16 using any suitable fastener means. The old corroded casing 9 is then extracted using the lift force exerted by the power winch 10 on the cross bar 30 with the cable line 15 passing over respective sheaves or pulleys 14 in the manner indicated in FIG. 5. In other words, the cable line 15 extends from the pulley 14 adjacent winch 10 around the pulley on the mule head or top bar 4 of the tower, then downwardly around the lower pulley 14 on the back foot bar 36*b*, and then upwardly and around the cable block 31 suspended beneath the top bar sleeve 28*a*, and finally around the pulley 14 on the lower cross bar or head plate bar 30 and back up to anchor on block 31. Thus, winding of cable line 15 onto the winch 10 will lift the bar 30 and thus will lift the old casing 9 upwardly out of the ground. Simultaneously with the lifting procedure, jetting water is forced into the annular space between the shoring sleeve 34 and old casing 9 down to the lowest level of casing 9. The jetting water collects within the shoring sleeve as the old casing is extracted, and is left in the sleeve to prevent collapse of the sleeve after removal of the casing.

Figure 5:
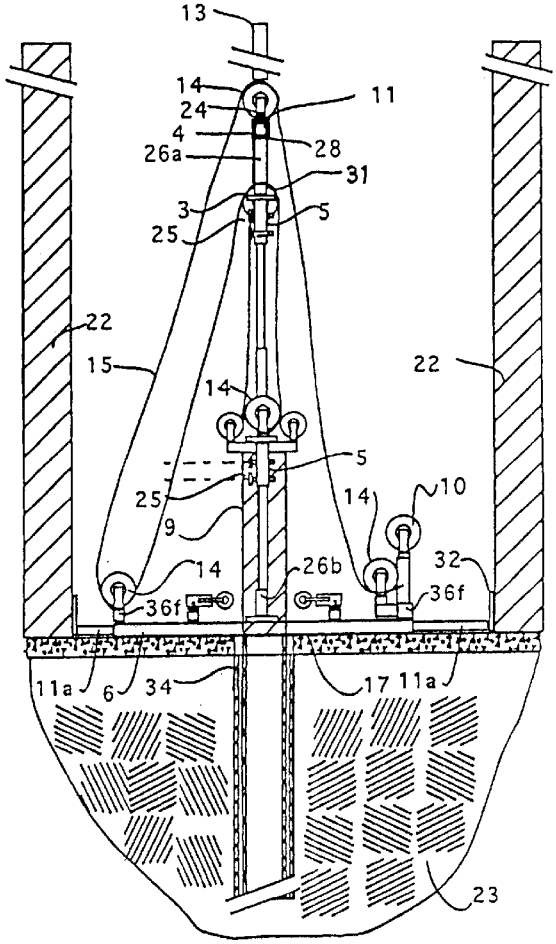
FIG. 5 is a side elevational view similar to FIG. 4, illustrating a subsequent step in the method after installation of the shoring sleeve, with the power winch in use to raise the head plate and attached cylinder casing.

The old casing may alternatively be lifted out of the ground using hydraulic jacks 29 as illustrated in FIG. 6, or jacks 29 and winch 10 may be used together to apply additional lifting force to the casing. The jacks are positioned between the jacking platforms 3 at opposite ends of lower cross bar 30 and the aligned jacking platforms projecting outwardly from opposite sides of the base 6 in alignment with the platforms 3 on cross bar 30. The jacks are then extended to exert upward force on the bar 30 as indicated, lifting the old casing 9 upwardly until it is completely extracted. The upper cross bar 19 is suitably re-positioned near the top of the vertical tower during casing extraction, as indicated in FIGS. 5 and 6, by releasing quick-connect pins 25 in order to allow the sleeves 5 to slide upwardly, and then re-inserting the pins 25 to lock the bar 19 in place. The bar 19 will then not interfere with the extraction process. The quick connect pins 25 on the sleeves 5 at the ends of the lower or head plate bar 30 may also be quickly removed to allow lifting of the bar, and then re-inserted after the casing is extracted, accelerating the removal process.

After the old, corroded casing 9 has been removed, a new elevator hydraulic jack cylinder casing 9 with an outer PVC protective casing or cover 8 is assembled and installed inside the shoring sleeve 34. The new casing 9 is first secured to the head plate 16 in alignment with the shoring sleeve 34, with the lower cross bar or head plate bar 30 secured in the raised position illustrated in FIGS. 5 and 6. The sliding roller guides 7 hold the new casing 9 in proper alignment with sleeve 34 as it is lowered into the ground, using either the power winch 10 in the manner indicated in FIG. 4, or hydraulic jacks positioned as in FIG. 1, in order to lower the casing. The water collected within the shoring sleeve 34 is displaced as the new casing 9 is lowered into the sleeve. As pipe joints on the outer protective casing 8 approach the sliding roller guides 7, the roller guides can be readily removed to allow the joints to pass the guides, and then re-secured to position the casing and ensure that critical alignment is maintained. Installation of the new casing 9 is then completed using normal industry practice. After installation, the tower is disassembled and removed from the hoistway, allowing the elevator to return to operation.

The method and apparatus of this invention allows old, corroded elevator hydraulic jack cylinder casings to be removed and replaced quickly and easily, while preventing cave-in of the bore hole in which the old casing was located. The outer shoring sleeve will prevent cave-ins and allow for easy insertion of the new casing 9 and protective cover 8 inside the sleeve. The method also allows better containment of any hydraulic fluid which may leak from the old casing during extraction. It also avoids the need for using the elevator car itself to mount a winch block used for lifting the old casing, and potential racking or misalignment of the elevator car due to the weight of the old casing.

Although an exemplary embodiment of the invention has been described above by way of example only, it will be understood by those skilled in the field that modifications may be made to the disclosed embodiment without departing from the scope of the invention, which is defined by the appended claims.

I claim:

1. An apparatus for removing an old elevator hydraulic cylinder casing from the ground and replacing it with a new hydraulic cylinder casing, comprising:

a vertical tower having a base for mounting on the floor of an elevator hoistway centered over an old in-ground elevator hydraulic cylinder casing with the tower extending vertically upwardly from the base;

a head plate slidably mounted on the tower for vertical movement up and down the tower;

a releasable locking device for releasably securing the head plate at a selected height on the tower, the head plate having a downwardly facing attachment device for securing the head plate to a shoring sleeve or cylinder casing; and a drive assembly linked to the head plate for moving the head plate upwardly and downwardly along the height of the tower with the locking device released, whereby the drive assembly forces the head plate downwardly along the tower to move the shoring sleeve or cylinder casing attached to the head plate to submerged, in-ground position below the floor of the elevator hoistway, and lifts the head plate upwardly to lift the old elevator hydraulic cylinder casing from an in-ground position to a removed position spaced above the floor of the elevator hoistway.

2. The apparatus as claimed in claim 1, wherein the drive assembly comprises a power winch and a cable and pulley linkage linking the winch to the head plate.

3. The apparatus as claimed in claim 2, wherein the tower has an upper end, and including a first cross beam extending across the upper end of the tower, the cable and pulley linkage comprising a first pulley secured to said first cross beam, a second pulley secured to said base, a third pulley secured to said head plate, and a line selectively extending from said winch around said third pulley and second pulley to lower said head plate, and around said first pulley, second pulley and third pulley to raise said head plate.

4. The apparatus as claimed in claim 2, wherein said drive assembly further comprises at least one hydraulic jack for applying increased upward and downward force to said head plate.

5. The apparatus as claimed in claim 1, wherein said drive assembly comprises at least one hydraulic jack.

6. The apparatus as claimed in claim 5, including an upper cross beam extending across said tower at a position spaced above said head plate, and a lower cross beam extending parallel to said upper cross beam and slidably mounted on said tower, said head plate being secured to said lower cross beam, and said hydraulic jack acting between said upper and lower cross beams in order to lower said head plate.

7. The apparatus as claimed in claim 6, including an hydraulic jack acting between said lower cross beam and said base in order to raise said head plate.

8. The apparatus as claimed in claim 1, including a plurality of inwardly directed guide rollers on said base defining an opening through which said shoring sleeve or cylinder casing extends as said shoring sleeve or cylinder casing is lowered into the ground, the guide rollers acting to guide said shoring sleeve or cylinder casing downwardly in alignment with a bore hole into which said shoring sleeve or cylinder casing are to be lowered.

9. The apparatus as claimed in claim 8, wherein the guide rollers are adjustably mounted on the base for rolling engagement with the outer periphery of said shoring sleeve or cylinder casing of varying diameter.

10. The apparatus as claimed in claim 1, wherein the tower has an upper end and a central longitudinal axis, the upper end of the tower including telescopically mounted expansion members projecting outwardly from said tower in opposite directions transverse to the longitudinal axis of said tower, each expansion member having an outer end, a flange secured to the outer end of each expansion member for releasably securing the expansion member to an elevator T-rail in an elevator hoistway, and releasable locking means for releasably securing each expansion member at a selected extension from said tower with said flange engaging the elevator T-rail.

11. The apparatus as claimed in claim 1, including said shoring sleeve or cylinder casing having a predetermined diameter greater than the diameter of the old in-ground cylinder casing to be replaced, for attachment to the head plate and installation into the ground to surround the old cylinder casing prior to extraction of the old casing.

12. A portable tower system for temporary installation within an elevator hoistway for removal and replacement of an old elevator hydraulic jack cylinder casing, the system comprising:

a mounting base for seating on a floor of an elevator hoistway;

a mounting assembly for releasably securing the mounting base at the lower end of an elevator hoistway;

a pair of spaced, vertical tower supports projecting upwardly from said mounting base;

a first pair of sleeves slidably mounted on said tower supports;

a head plate bar having opposite ends secured to said sleeves;

a first set of quick connect pins for releasably securing said first pair of sleeves at a selected position on said respective tower supports;

a second pair of sleeves slidably mounted on the respective tower supports above the first pair of sleeves;

a cross beam having opposite ends secured to said sleeves;

a second set of quick connect pins for releasably securing said second pair of sleeves at a selected position on said respective tower supports;

the tower supports each having an upper end;

an upper cross bar secured between the upper ends of said tower supports;

a pair of expansion end members each telescopically engaged in opposite ends of said upper cross bar to project transversely outwardly from the respective tower support;

each expansion end member having an outer end comprising an attachment flange for releasably securing the end member to an elevator T-rail;

a first horizontal sleeve slidably mounted on said upper cross bar;

a first releasable fastener for releasably securing the first horizontal sleeve at a selected position on said upper cross bar, whereby said first sleeve is securable at a central position on said first sleeve aligned with a central axis of the old cylinder casing;

a second horizontal sleeve slidably mounted on said head plate bar;

a second releasable fastener for releasably securing the second horizontal sleeve at a selected position on said head plate bar, whereby said second sleeve is securable at a central position on said second sleeve aligned with a central axis of the old cylinder casing;

said mounting base including first and second spaced foot bars extending parallel to said head plate and upper cross bars on opposite sides of the tower supports;

third and fourth horizontal sleeves slidably mounted on said first and second foot bars, respectively;

third and fourth releasable fasteners for releasably securing the third and fourth horizontal sleeves at selected positions on said first and second foot bar, respectively, in transverse alignment with the central positions on said first and second sleeves;

a first pulley mounted at a central position on the first sleeve;

a second pulley mounted at a central position on said second sleeve;

third and fourth pulleys mounted at a central position on said third and fourth sleeves, respectively;

a power winch mounted on said base;

a cable extending from said power winch around said pulleys, whereby said power winch, cable and pulleys apply upward and downward force to said head plate;

four framing channels secured on said base to form a square frame surrounding and centered on the old cylinder casing; and a roller guide adjustably secured to each framing channel for engaging the periphery of a cylindrical casing to act as a guide as said casing is lifted out of a bore hole or lowered into the bore hole.

13. A portable tower system for temporary installation within an elevator hoistway for removal and replacement of an old elevator hydraulic jack cylinder casing, the system comprising:

a mounting base for seating on a floor of an elevator hoistway;

a mounting assembly for releasably securing the mounting base at the lower end of said elevator hoistway;

a pair of spaced, vertical tower supports projecting upwardly from said mounting base;

a first pair of sleeves slidably mounted on said tower supports;

a head plate bar having opposite ends secured to said sleeves;

a first set of quick connect pins for releasably securing said first pair of sleeves at a selected position on said respective tower supports;

a second pair of sleeves slidably mounted on the respective tower supports above the first pair of sleeves;

a cross beam having opposite ends secured to said sleeves;

a second set of quick connect pins for releasably securing said second pair of sleeves at a selected position on said respective tower supports;

the tower supports each having an upper end;

an upper cross bar secured between the upper ends of said tower supports;

a pair of expansion end members each telescopically engaged in opposite ends of said upper cross bar to project transversely outwardly from the respective tower support;

each expansion end member having an outer end comprising an attachment flange for releasably securing the end member to an elevator T-rail;

at least one hydraulic jack for engagement between said upper cross beam and head plate bar to apply downward force to said head plate bar, and between said base and head plate bar to apply upward force to said head plate bar;

four framing channels secured on said base to form a square frame surrounding and centered on the old cylinder casing; and a roller guide adjustably secured to each framing channel for engaging the periphery of a cylindrical casing to act as a guide as said casing is lifted out of a bore hole or lowered into the bore hole.

14. A method of removing and replacing an old in-ground elevator hydraulic cylinder casing, comprising the steps of:

loosening an elevator hoistway floor and subsoil surrounding an old in-ground elevator hydraulic cylinder casing to leave an annular gap around the casing;

centering a shoring sleeve of larger diameter than the old in-ground hydraulic cylinder casing in an elevator hoistway above the floor of the hoistway such that a central axis of the shoring sleeve is aligned with a central axis of the in-ground cylinder casing;

lowering the shoring sleeve into the annular gap around the old in-ground cylinder casing and forcing down until the shoring sleeve surrounds the entire outer surface of the casing to a depth below the lower end of the old cylinder casing;

pulling the old cylinder casing upwardly into the hoistway and disposing of the extracted old cylinder casing; and lowering a new hydraulic cylinder casing into the shoring sleeve.

15. The method as claimed in claim 14, wherein the steps of lowering the shoring sleeve and new cylinder casing and pulling the old cylinder casing upwardly comprise positioning a head plate bar to extend horizontally across part of the hoistway above the old cylinder casing, slidably mounting the head plate bar for vertical movement on a tower seated in the elevator hoistway, securing a head plate mounted at the center of the head plate bar to the cylinder casing or shoring sleeve, and actuating a drive assembly to force the head plate bar, head plate and attached casing or shoring sleeve upwardly or downwardly.

16. The method as claimed in claim 15, wherein the step of lowering the shoring sleeve comprises mounting at least one hydraulic jack between the head plate bar and a cross beam in the tower spaced above and parallel to the head plate bar, and actuating the jack to apply downward force to the head plate bar.

17. The method as claimed in claim 16, wherein the step of lifting an old cylinder casing comprises lowering the head plate bar to a position adjacent an upper end of the old cylinder casing, attaching the head plate to the old cylinder casing, mounting at least one hydraulic jack between the lower end of the tower and the head plate, and actuating the hydraulic jack to apply upward force to the head plate bar and attached old cylinder casing.

18. The method as claimed in claim 15, wherein the step of actuating a drive assembly to raise or lower the head plate bar comprises connecting a power winch to the tower, extending a line from the winch around pulleys secured to the tower and head plate bar, and operating the winch to lift or lower the head plate bar.

19. The method as claimed in claim 14, wherein the step of loosening the subsoil surrounding the in-ground cylinder casing comprises jetting water and pressurized air into the area surrounding the old cylinder casing in order to provide the annular gap around the in-ground cylinder casing.

20. The method as claimed in claim 19, including the step of jetting pressurized water into a space between the shoring sleeve and in-ground cylinder casing as the old in-ground cylinder casing is pulled upwardly out of the ground, whereby water remains within the shoring sleeve after removal of the old in-ground cylinder casing said water being displaced as the new cylinder casing is lowered into the shoring sleeve.

* * * * *

UNITED STATES PATENT AND TRADEMARK OFFICE

CERTIFICATE OF CORRECTION

PATENT NO. : 6,354,769 B1
DATED : March 12, 2002
INVENTOR(S) : Patrick Richard Allen It is certified that error appears in the above-identified patent and that said Letters Patent is hereby corrected as shown below:

Column 11,
Line 5, insert after "forcing": -- the shoring sleeve --

Signed and Sealed this

Twenty-seventh Day of August, 2002

*Attest:*

*Attesting Officer*

JAMES E. ROGAN
*Director of the United States Patent and Trademark Office*